US008430693B2

(12) United States Patent
Wu

(10) Patent No.: US 8,430,693 B2
(45) Date of Patent: Apr. 30, 2013

(54) LOW PROFILE CABLE ASSEMBLY

(75) Inventor: Jerry Wu, Irvine, CA (US)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 41 days.

(21) Appl. No.: 13/237,899

(22) Filed: Sep. 20, 2011

(65) Prior Publication Data

US 2012/0071020 A1 Mar. 22, 2012

(51) Int. Cl.
*H01R 13/648* (2006.01)

(52) U.S. Cl.
USPC ..... 439/607.5; 439/660

(58) Field of Classification Search ..... 439/607.45, 439/607.46, 607.5, 51, 660
See application file for complete search history.

(56) References Cited

U.S. PATENT DOCUMENTS

| | | | | |
|---|---|---|---|---|
| 7,371,118 | B2 * | 5/2008 | Wu | 439/607.45 |
| 7,618,293 | B2 | 11/2009 | Wu | |
| 7,922,536 | B2 * | 4/2011 | Zhang et al. | 439/607.45 |
| 8,070,525 | B2 * | 12/2011 | Hou et al. | 439/660 |
| 8,123,558 | B2 * | 2/2012 | Su et al. | 439/607.01 |

* cited by examiner

*Primary Examiner* — Hien Vu
(74) *Attorney, Agent, or Firm* — Wei Te Chung; Ming Chieh Chang

(57) ABSTRACT

A cable assembly includes an insulative housing defining a front portion and a rear portion and a plurality of terminals integrally formed with the insulative housing and extending into the front portion. A substrate is located at the rear portion and connected with the terminals. A shell assembly is attached to the insulative housing and includes a first shell enclosing the front portion and a second shell substantially enclosing the rear portion of the housing. The second shell defines a front edge having a plurality of fingers thereof interengaged with the first shell. A cable has a plurality of conductors each interconnected to the substrate with respect to the contact terminals.

10 Claims, 6 Drawing Sheets

LOW PROFILE CABLE ASSEMBLY

BACKGROUND OF THE INVENTION

1. Field of the Invention

The present invention relates to a cable assembly, and more particularly to a low profile cable assembly with an improved metallic shell configured by a front shell and a rear shell interlinked to the front shell.

2. Description of Related Art

U.S. Pat. No. 7,618,293 issued to Wu on Nov. 17, 2009 discloses an electrical connector including an insulative housing, a plurality of terminals and a metal shell enclosing the insulative housing. The metal shell comprises a lower first half and an upper second half engaging with the first half to form the whole metal shell. The first half comprises a front tube-shape mating frame and a rear U-shape holding section with opposite flanges each formed with a pair of tubers bending outwardly for engaging with locking holes of the second half to secure the first and second halves. The front mating frame defines two pairs of rectangular windows in upper and lower walls thereof and a rear locking opening in upper wall adjacent to the holding section. The second half is assembled to the rear holding section of the first half and comprises an n-shape front holding section and a rear crimping section for grasping the cable to realize strain relief The holding section forms two pairs of locking holes in opposite lateral walls thereof and a bending tab bending from a front edge of upper wall thereof to lock into the locking opening of the first half The structure of the metal shell is complicated.

Hence, a cable electrical connector assembly with an improved metallic shell is needed to solve the above problem.

BRIEF SUMMARY OF THE INVENTION

The present invention provides a cable assembly including an insulative housing defining a front portion and a rear portion and a plurality of terminals integrally formed with the insulative housing and extending into the front portion. A substrate is located at the rear portion and connected with the terminals. A shell assembly is attached to the insulative housing and includes a first shell enclosing the front portion and a second shell substantially enclosing the rear portion of the housing. The second shell defines a front edge having a plurality of fingers thereof interengaged with the first shell. A cable has a plurality of conductors each interconnected to the substrate with respect to the contact terminals.

Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

Figure 1:
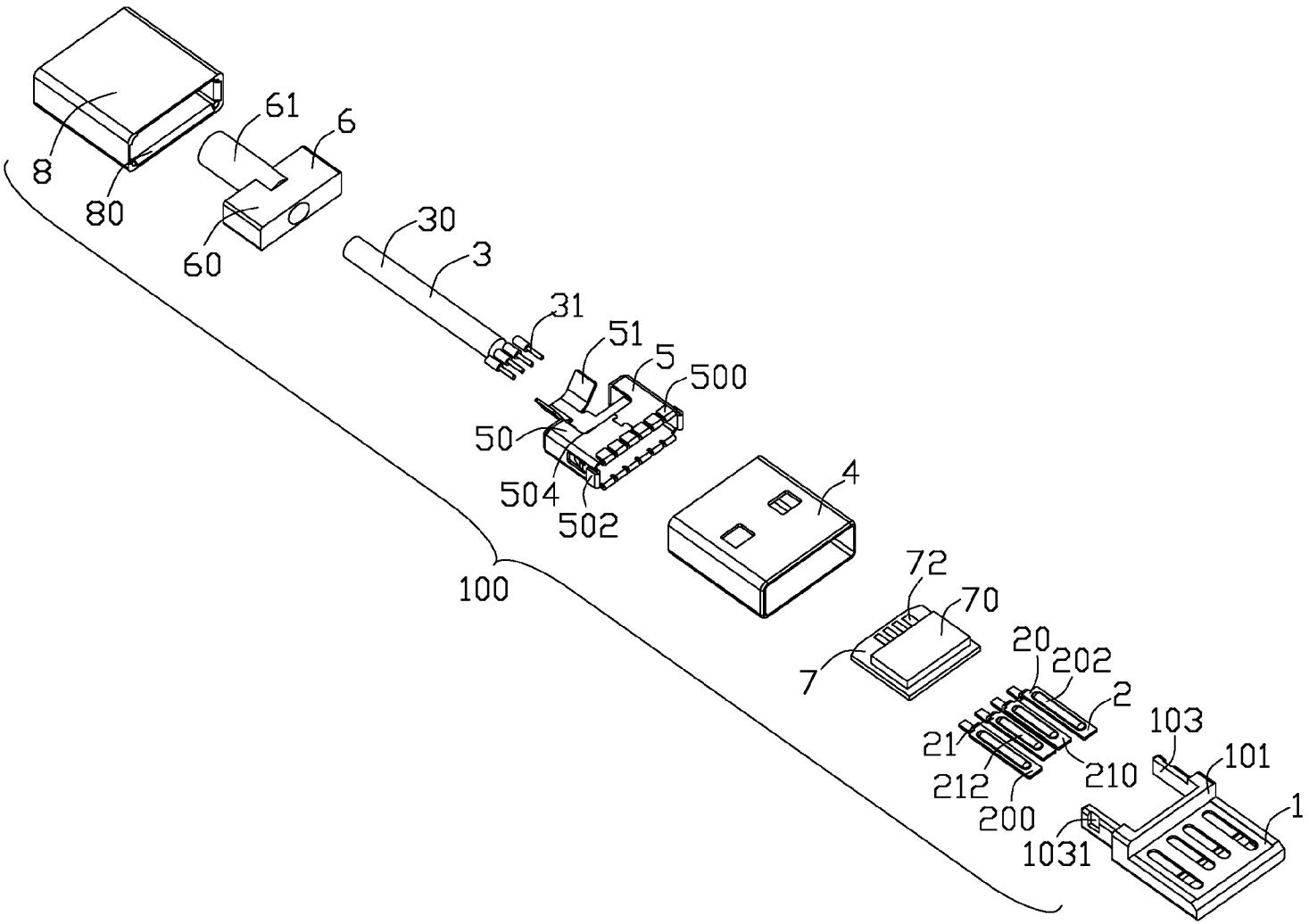
FIG. 1 is an exploded view of a cable electrical connector assembly in accordance with an embodiment of the present invention.

Reference will now be made to the drawing figures to describe the preferred embodiment of the present invention in detail.

As shown in FIGS. 1 to 6, a cable assembly 100 includes a plurality of terminals 2 and an insulative housing 1 formed by over molded around the terminals 2. A substrate 7 is located at a rear portion of the housing 1 and connects with the terminals 2. A shell assembly is attached to the insulative housing 1. A cable 3 has a plurality of conductors 31 each interconnected to the substrate 7 with respect to the contact terminals.

Figure 2:
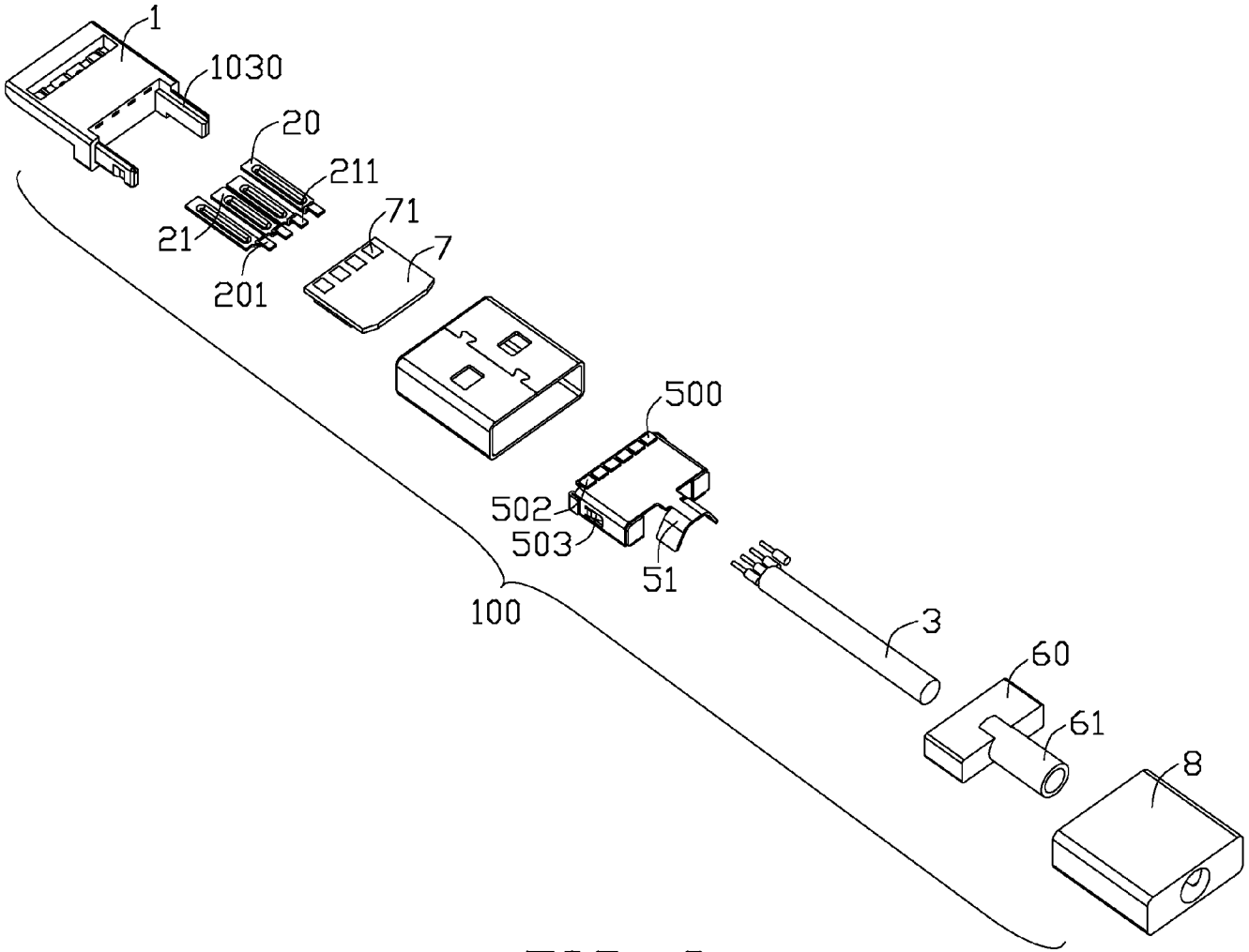
FIG. 2 is a view similar to FIG. 1, but viewed from a different aspect.
Figure 3:
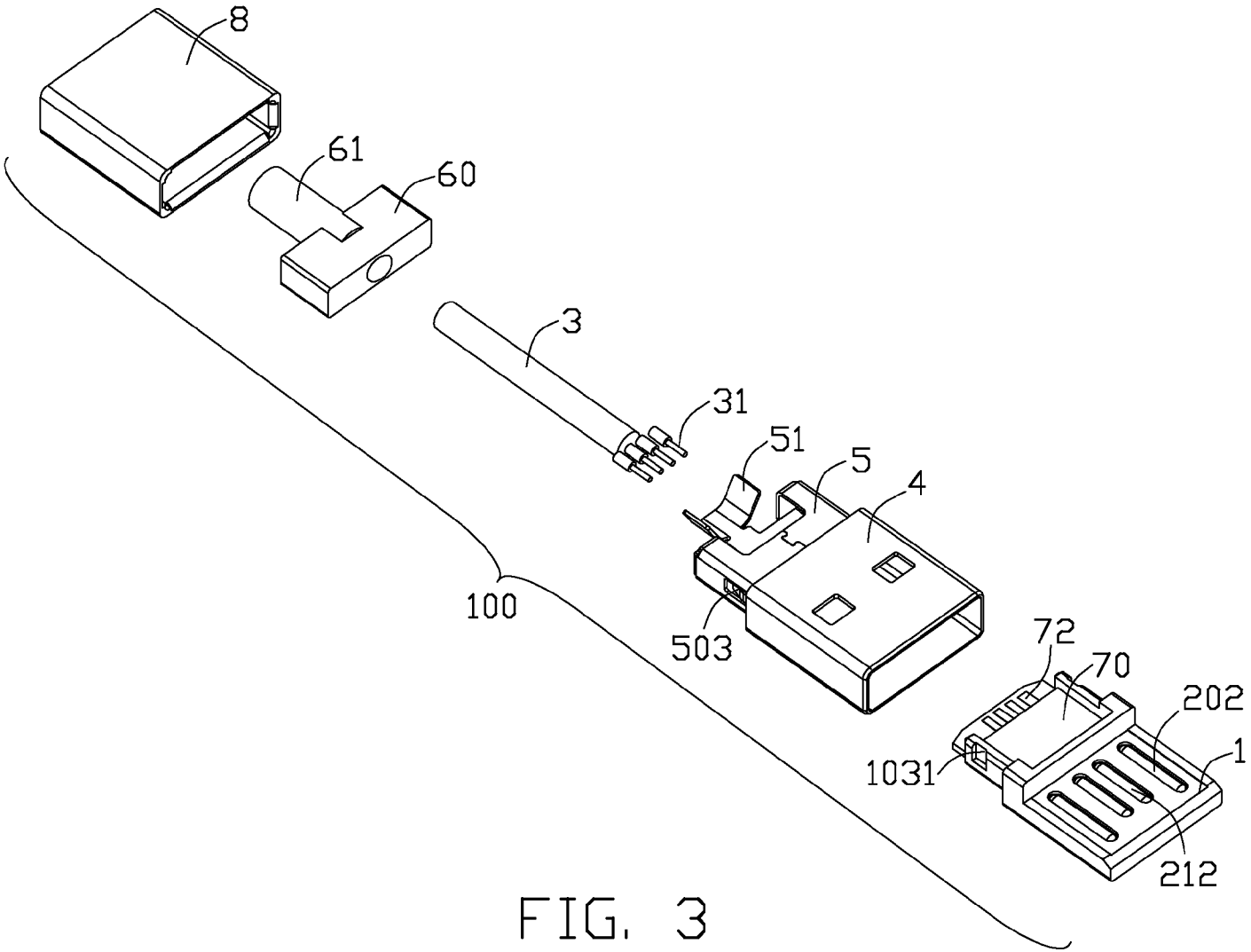
FIG. 3 is a partially assembled view of the cable electrical connector assembly.
Figure 4:
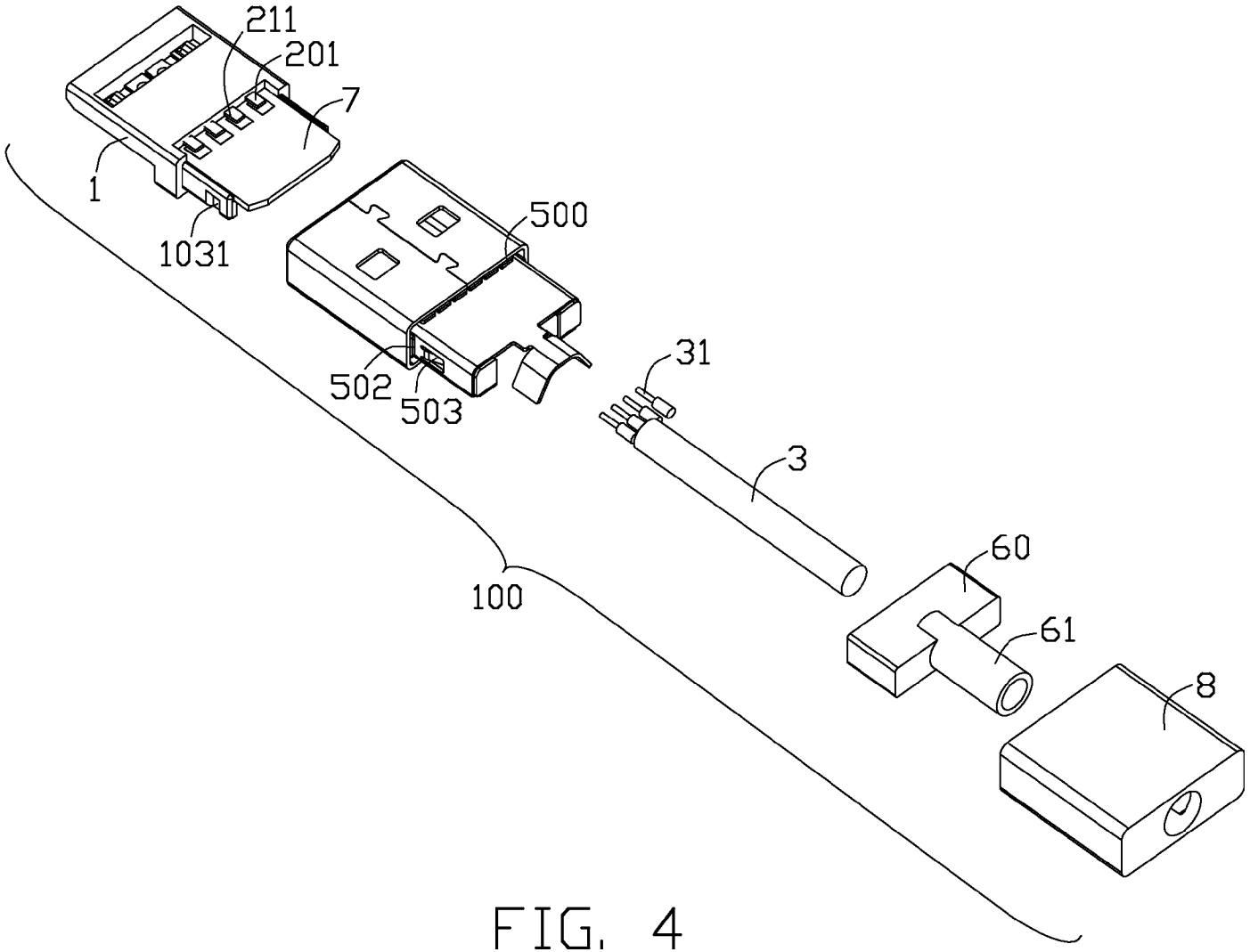
FIG. 4 is a view similar to FIG. 3, but viewed from a different aspect.
Figure 5:
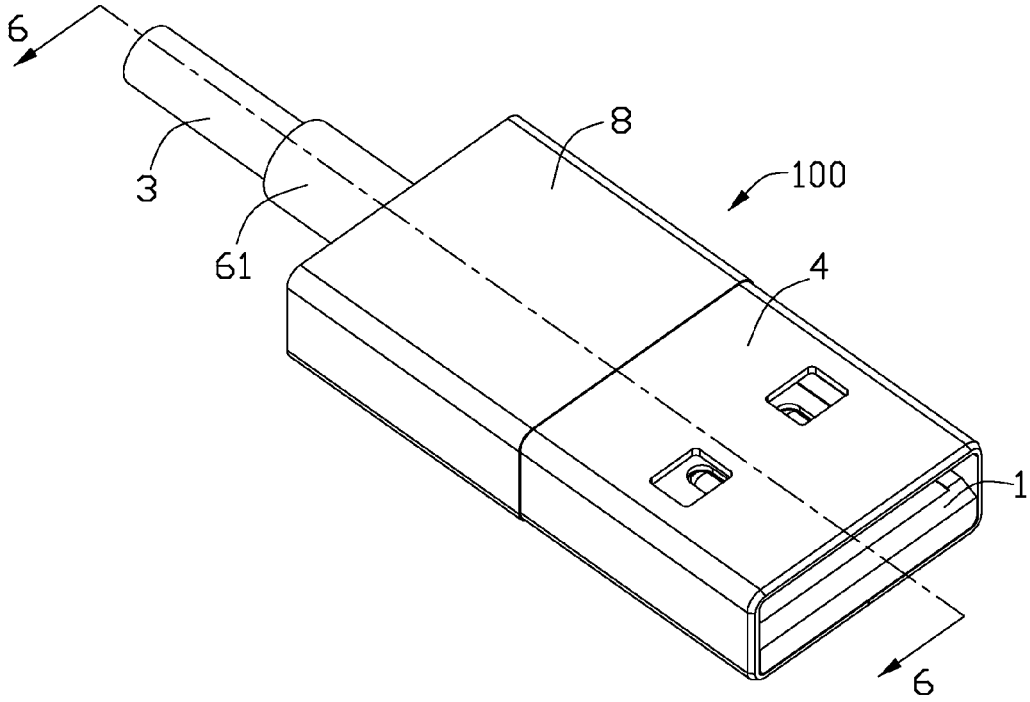
FIG. 5 is an assembled, perspective view of the cable electrical connector assembly.
Figure 6:
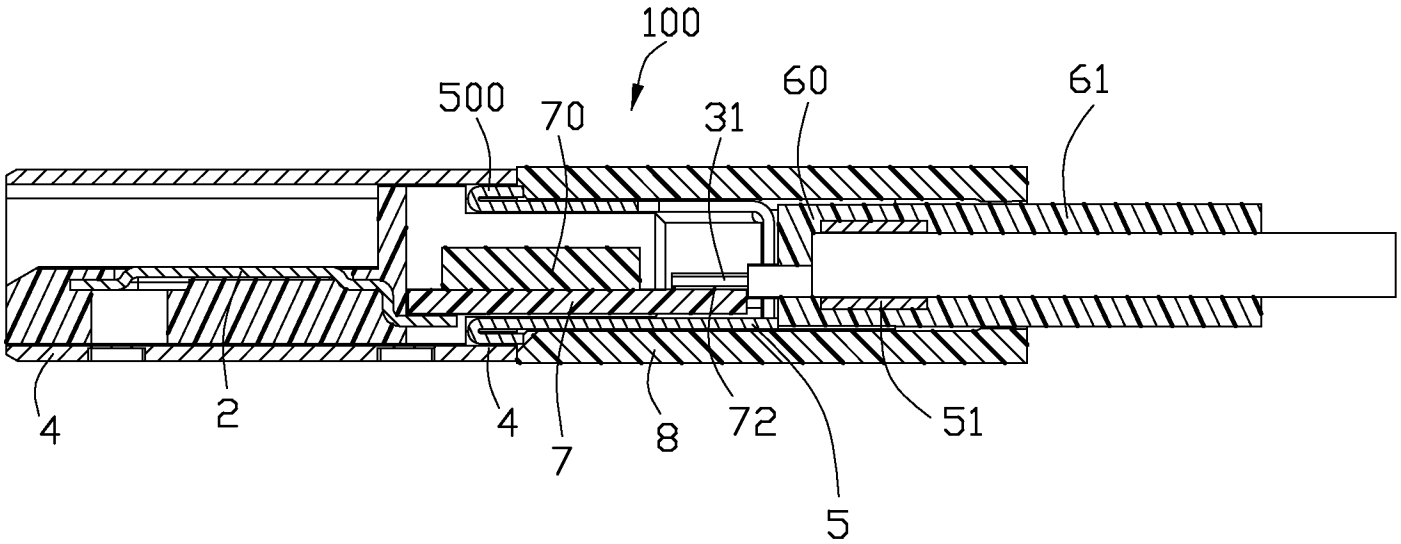
FIG. 6 is a cross-section view taken along line 6-6 of FIG. 5.

Referring to FIGS. 1 and 2, the insulative housing 1 includes a plate portion 101 and a pair of cantilever arms 103 extends rearward from the plate portion 101. The terminals 2 comprise a pair of first terminals 20 and a pair of second terminals 21 located between said first terminals 20. The first terminals 20 comprises first mating sections 200 retained in the plate portion 101 and first tail sections 201 extending rearwards and downwardly form the first mating sections 200. The second terminals 21 comprise second mating sections 210 retained in the plate portion 101 and second tail sections 211 extending rearwards and downwardly from the second mating sections 210. The first mating sections 200 of the first terminals 20 define first protrusions 202 extending upwardly from upper surfaces thereof. The second mating sections 210 of the second terminals 21 define second protrusions 212 extending upwardly from upper surfaces thereof. The first and second protrusions 202, 212 are exposed on a top surface of the plate portion 101.

A substrate 7 is located between the cantilever arms 103. There is a set of first conductive pads 71 located on a front edge of a bottom surface of the substrate 7. The first conductive pads 71 are respectively soldered with the first tail sections 201 of the first terminals 20 and the second tail sections 211 of the second terminals 21. There is a set of second conductive pads 72 located on a rear edge of a top surface of the substrate 7. Some electronic components 70 such as capacitance are positioned on a top surface of the substrate 7.

The shell assembly includes a first metallic shell 4 enclosing a front portion of the insulative housing 1 and a second metallic shell 5 enclosing a rear portion of the insulative housing 1. The second metallic shell 5 is located in rear of the first metallic shell 4. A second metallic shell 5 is interengaged with the first metallic shell 4 and with the cantilever arms 103 located within the second shell 5. Opposite second surfaces of the cantilever arms 103 define a pair of guide slots 1030 located adjacent to a bottom surface thereof. First surfaces of the cantilever arms 130 define a pair of notches 1031 extending through a top surface thereof. The second metallic shell 5 comprises a rectangular frame section 50 and a stain relief 51 extending rearwards from the frame section 50 for grasping the cable 5. The frame section 50 comprises a plurality of first fingers 500 outwardly folded from front ends of top and bottom walls thereof and a pair of second fingers 502 outwardly folded from front ends of two side walls thereof. The first and second fingers 500, 502 are connected with a rear edge of a second surface of the first metallic shell 4. A pair of elastic tabs 503 extends inwardly from the side walls of the frame section 50 and is located behind the second fingers 502 so as to engage with the corresponding notches 1031. As shown in FIG. 1, the top wall of the frame section 50 defines an opening 504 in the rear thereof for soldering the cable 5 to a printed circuit board 7.

The cable 3 comprises a plurality of central conductors 31, a insulating layer 30 encircling the central conductors 31. The central conductors 31 of the cable 3 are soldered with the second conductive pads 72 of the substrate 7.

The cable assembly 100 further comprises an overmold body or so-called enlarged strain relief 6 which is over molded the cable 5. The overmold body 6 is located in back of the frame section 50 and comprises a rectangular portion 60 and a tube portion 61 extending rearwards from the rectangular portion 60. The rectangular portion 60 encloses the stain relief 51 and the tube portion 61 encloses the cable 3.

The cable assembly 100 further comprises an insulative cover 8 enclosing the second metallic shell 5 and the overmold body 6. The insulative cover 8 comprises a protrusion 80 projecting inwardly from a front edge of a second surface thereof.

Referring to FIGS. 1-2 in conjunction with FIGS. 3-6, in assembly, firstly the insulative housing 1 is over molded around the first and second terminals 20, 21, so that the first tail sections 201 of the first terminals 20 and the second tail sections 211 of the second terminals 21 extend beyond the rear edge of the plate portion 101 and are located between the cantilever arms 103. Secondly, the substrate 7 is inserted into the guide slots 1030 along a back-to-front direction, and the first tail sections 201 of the first terminals 20 and the second tail sections 211 of the second terminals 21 are soldered onto the first conductive pads 71 of the substrate 7. Thirdly, the first and second fingers 500, 502 of the second metallic shell 5 are soldered to a rear edge of an second surface of the first metallic shell 4 to form a shell assembly, and the shell assembly is assembled to the insulative housing 1 with the substrate 7 along the back-to-front direction so that the elastic tabs 503 of the second metallic shell 5 engage with the notches 1031 of the cantilever arms 103. Fourthly, the conductors 31 of the cable 3 are soldered to the second conductive pads 72 of the substrate 7 and the strain relief 51 grasps the cable 3. Fifthly, the overmold body 6 is over molded the cable 5 and the strain relief 51 and abuts against a rear surface of the frame portion 50. The insulative cover 8 is assembled to enclose the second metallic shell 5 and the overmold body 6.

It is to be understood, however, that even though numerous, characteristics and advantages of the present invention have been set forth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A cable assembly, comprising an insulative housing defining a front portion and a rear portion;

a plurality of terminals integrally formed in the insulative housing and extending into the front portion;

a substrate with conductive pads located at the rear portion and connected with the terminals;

a shell assembly attached to the insulative housing and comprising a first metallic shell enclosing the front portion and a second metallic shell substantially enclosing the rear portion of the housing and being positioned in the first metallic shell, the second metallic shell defines a front edge having a plurality of fingers thereof engaged with a rear portion of the first metallic shell;

a cable configured with a plurality of conductors each interconnected to the substrate with respect to the contact terminals;

wherein the front edge of the second metallic shell is outwardly and rearwards folded to form said fingers;

wherein the insulative housing comprises a plate portion enclosed by the first metallic shell and a pair of cantilever arms extending rearwards from a rear edge of the plate portion to position the substrate;

wherein a row of first conductive pads is located on a front edge of a bottom surface of the substrate for soldering with the tail sections of the terminals, a row of second conductive pads is located on a rear edge of a top surface of the substrate for soldering with the conductors of the cable; and wherein the pair of cantilever arms defines a pair of guide slots in opposite second surfaces thereof to engage with the substrate.

2. The cable assembly as claimed in claim 1, wherein a pair of elastic tabs extends inwardly from two side walls of the second metallic shell and is located behind the second fingers so as to engage with the insulative housing.

3. The cable assembly as claimed in claim 2, wherein the pair of cantilever arms defines a pair of notches in opposite first surfaces thereof to latch with the elastic tabs of the second metallic shell.

4. The cable assembly as claimed in claim 1, wherein the second metallic shell define an opening to facilitate soldering the conductors of the cable onto the substrate.

5. A cable assembly, comprising an insulative housing defining a front portion integrally formed with a plurality of contact terminals, and a rear portion configured with a pair of cantilever arms and tails of the contact terminals extending into the rear portion;

a substrate supported between the pair of arms and interlocked with the terminal tails;

a cable configured with a plurality of conductors each interconnected to corresponding rear conductive pad of the substrate;

a metallic shell assembled to the insulative housing, and including a front portion enclosing the front portion of the housing, and a rear portion engaged into a rear portion of the front portion, and having a strain relief clamped to the cable;

wherein the rear portion of the metallic shell defines a plurality of fingers soldered on an inner face of a rear opening of the front portion;

wherein the fingers fold outwards and rearwards from a front edge of the rear portion of the metallic shell and are soldered on an inner face of a rear opening of the front portion; and wherein the pair of cantilever arms defines a pair of guide slots in opposite second surfaces thereof to engage with the substrate.

6. A cable connector assembly comprising:

an insulative housing defining a mating port;

a plurality of contacts disposed in the housing with front contacting sections exposed in the mating port and a rear tail sections in a front-to-back direction;

a cable including a plurality of wires located behind the housing and electrically connected to the tail sections of the corresponding contacts, respectively;

a rear metallic shell located behind the mating port of the housing and including a first strain relief structure clamping a front end region of the cable;

an insulative overmold structure integrally formed upon the front end region of the cable with a front transversely enlarged block type structure thereof, and enclosing the first strain relief structure to result in a second strain relief structure;

wherein a front metallic shell enclosing the mating port and fastened over a front portion of the rear metallic shell that the rear metallic shell has a plurality of folded back fingers at a front edge of the front portion;

wherein the rear metallic shell encloses a printed circuit board on which the tail sections of the contacts and the wires are mechanically connected;

wherein the housing defines a pair of side arms extending rearwardly from the mating port to retain the printed circuit board therebetween in a transverse direction; and wherein the tail sections and the wires are mechanically connected to opposite surfaces of the printed circuit board.

7. The cable connector assembly as claimed in claim 6, further including an insulative sleeve type cover directly circumferentially enclosing both the rear metallic shell and the insulative overmold structure.

8. The cable connector assembly as claimed in claim 7, wherein insulative overmold structure further includes a rear tube portion directly surrounding the cable with a diameter slightly larger than that of the cable, under condition that a rear end section of the rear tube portion is exposed outside of the insulative sleeve type cover.

9. The cable connector assembly as claimed in claim 7, wherein a contour of the rear metallic shell and that of the insulative overmold structure are essentially coplanar with each other.

10. The cable connector assembly as claimed in claim 6, wherein the contacts are insert molded within the housing.

* * * * *